US007856198B2

(12) United States Patent
Saito et al.

(10) Patent No.: US 7,856,198 B2
(45) Date of Patent: Dec. 21, 2010

(54) TONER CARTRIDGE AND IMAGE FORMING APPARATUS

(75) Inventors: Kazuhiro Saito, Saitama (JP); Atsuna Saiki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 753 days.

(21) Appl. No.: 11/693,142

(22) Filed: Mar. 29, 2007

(65) Prior Publication Data

US 2008/0080902 A1 Apr. 3, 2008

(30) Foreign Application Priority Data

Oct. 3, 2006 (JP) ..... 2006-271668

(51) Int. Cl.
*G03G 15/00* (2006.01)
*G03G 15/08* (2006.01)

(52) U.S. Cl. ..... 399/262; 399/119; 399/120

(58) Field of Classification Search ..... 399/119, 399/207, 260, 262, 263; 222/DIG. 1
See application file for complete search history.

(56) References Cited

U.S. PATENT DOCUMENTS 5,455,662 A * 10/1995 Ichikawa et al. ..... 399/260
7,218,866 B2 * 5/2007 Hayashi et al. ..... 399/12
7,277,664 B2 * 10/2007 Katsuyama et al. ..... 399/258
7,302,213 B2 * 11/2007 Kimura et al. ..... 399/262
7,386,250 B2 * 6/2008 Ban et al. ..... 399/106
2004/0161267 A1 * 8/2004 Ichikawa et al. ..... 399/262
2007/0196136 A1 8/2007 Yamamoto et al.
2007/0269237 A1 * 11/2007 Sato ..... 399/260
2008/0013988 A1 * 1/2008 Murakami et al. ..... 399/258
2008/0101821 A1 * 5/2008 Gayne et al. ..... 399/258

FOREIGN PATENT DOCUMENTS

CN 101025592 A 8/2007
JP 09-244378 A 9/1997
JP 2003-295562 A 10/2003

OTHER PUBLICATIONS

Chinese Office Action for Chinese Patent Application 200710090190.0 dated Jul. 10, 2009.

* cited by examiner

*Primary Examiner*—David M Gray
*Assistant Examiner*—Francis Gray
(74) *Attorney, Agent, or Firm*—Sughrue Mion, PLLC

(57) ABSTRACT

A toner cartridge includes: a cartridge main body having an opening; a toner chamber that is provided inside the cartridge main body and contains toner; an open-close member that opens/closes the opening by moving; and a regulation part that regulates movement of the open-close member in an opening/closing direction when the cartridge main body is moved in a direction where it is removed/attached to/from an image forming apparatus, wherein the opening enables movement of the toner between a position inside the toner chamber and a position outside the cartridge main body.

24 Claims, 16 Drawing Sheets

10

S20

TONER CARTRIDGE AND IMAGE FORMING APPARATUS

CROSS-REFERENCE TO RELATED APPLICATIONS

This application is based on and claims priority under 35 USC 119 from Japanese Patent Application No. 2006-271668 filed Oct. 3, 2006.

BACKGROUND

Technical Field

The present invention relates to a toner cartridge containing toner and an image forming apparatus.

SUMMARY

According to an aspect of the invention, there is provided a toner cartridge including: a cartridge main body having an opening; a toner chamber that is provided inside the cartridge main body and contains toner; an open-close member that opens/closes the opening by moving; and a regulation part that regulates movement of the open-close member in an opening/closing direction when the cartridge main body is moved in a direction where it is removed/attached to/from an image forming apparatus, wherein the opening enables movement of the toner between a position inside the toner chamber and a position outside the cartridge main body.

BRIEF DESCRIPTION OF THE DRAWINGS

An exemplary embodiment of the present invention will be described in detail based on the following figures, wherein.

DETAILED DESCRIPTION

Next, an exemplary embodiment of the present invention will be described based on the drawings.

Figure 1:
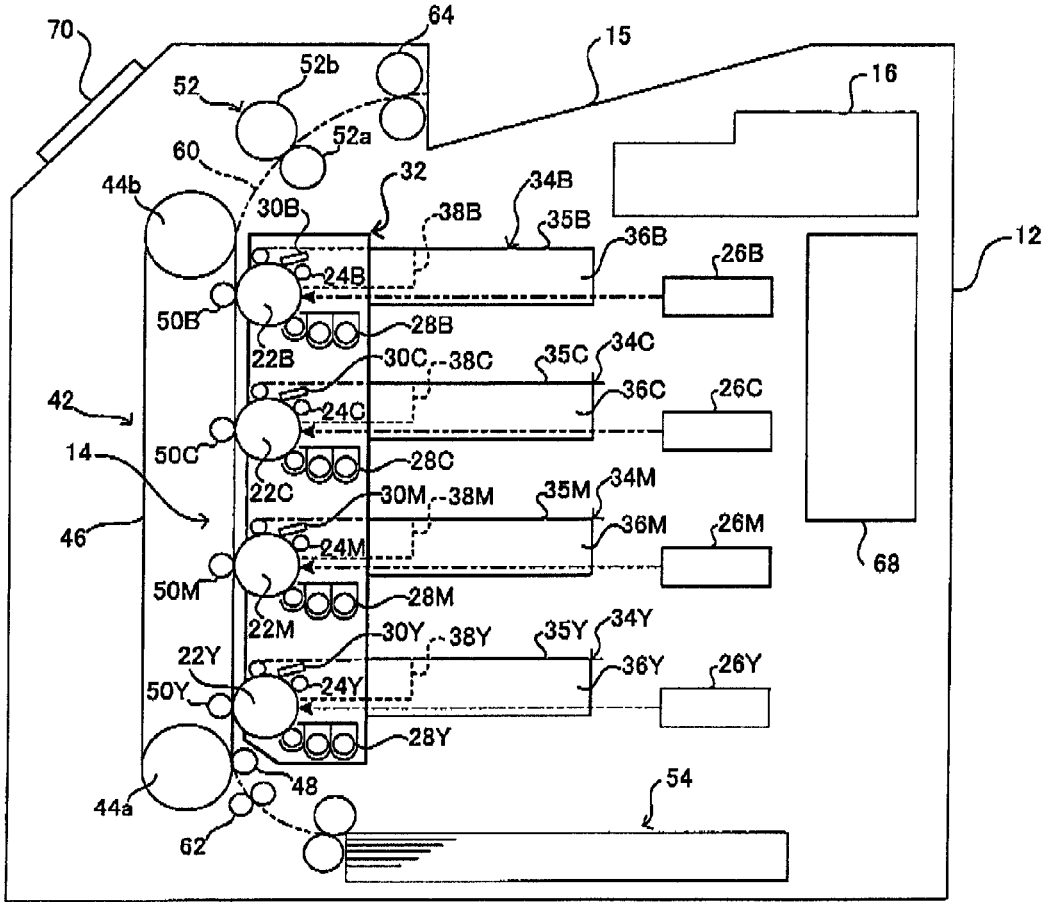
FIG. 1 is a cross-sectional view showing a overview of an image forming apparatus, viewed from a side position, according to an exemplary embodiment of the present invention.
Figure 2:
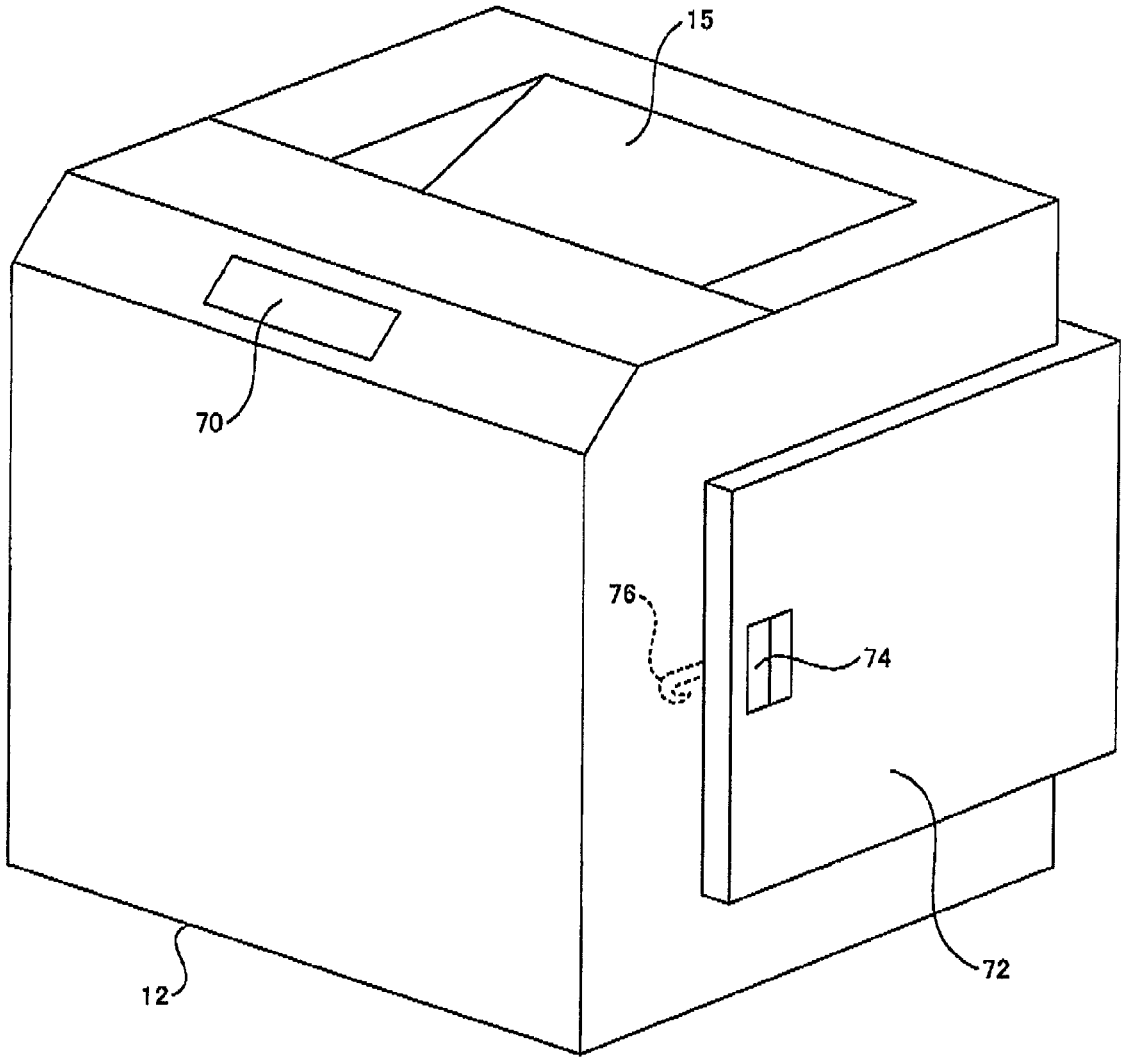
FIG. 2 is a perspective view showing an exterior appearance of the image forming apparatus according to the exemplary embodiment of the present invention.

FIGS. 1 and 2 show an image forming apparatus 10 according to the exemplary embodiment of the present invention. The image forming apparatus 10 has an image forming apparatus main body 12. An image forming part 14, a sheet feeder 54 to feed a sheet to the image forming part 14, a power source unit 16 and a controller 68 having a CPU (not shown) and the like, are provided in the image forming apparatus main body 12. The controller 68 controls respective constituent elements of the image forming apparatus 10. Further, a sheet discharge part 15 on which a sheet subjected to image formation is discharged is provided in an upper part of the image forming apparatus main body 12.

The image forming part 14 is an electrophotographic type unit to form a color image. The image forming part 14 has drum-shaped photoreceptors 22Y, 22M, 22C and 22B as image holders to hold toner images, charging devices 24Y, 24M, 24C and 24B as chargers having charging rollers to uniformly charge the respective photoreceptors 22Y, 22M, 22C and 22B, optical writers 26Y, 26M, 26C and 26B as latent image forming units to optically write latent images on the photoreceptors 22Y, 22M, 22C and 22B, developing units 28Y, 28M, 28C and 28B to develop the latent images written on the respective photoreceptors 22Y, 22M, 22C and 22B using two-component type developing material including non-magnetic toner and magnetic carrier, a transfer unit 42 used as a transfer unit to transfer the toner images formed on the respective photoreceptors 22Y, 22M, 22C and 22B onto a sheet, and cleaners 30Y, 30M, 30C and 30B to collect waste toner remaining on the photoreceptors 22Y, 22M, 22C and 22B by e.g. scraping after the transfer of the toner images with the transfer unit 42.

The optical writers 26Y, 26M, 26C and 26B respectively have a laser exposure device. The optical writer 26Y emits laser a beam corresponding to a yellow image onto the photoreceptor 22Y; the optical writer 26M emits a laser beam corresponding to a magenta image onto the photoreceptor 22M; the optical writer 26C emits a laser beam corresponding to a cyan image onto the photoreceptor 22C; and the optical writer 26B emits a laser beam corresponding to a black image onto the photoreceptor 22B. Thus the optical writers 26Y, 26M, 26C and 26B write latent images into the photoreceptors 22Y, 22M, 22C and 22B.

Among the constituent elements of the image forming part 14, the photoreceptors 22Y, 22M, 22C and 22B, the charging devices 24Y, 24M, 24C and 24B, the developing units 28Y, 28M, 28C and 28B, and the cleaners 30Y, 30M, 30C and 30B are integrated as an image forming unit 32 as an exchangeable unit and attached to the image forming apparatus main body 12 removably from a front surface side (left side in FIG. 1).

Further, the photoreceptor 22Y, the charging device 24Y and the cleaner 30Y are integrated as a photoreceptor unit 112 to be described later. Similarly, the photoreceptors 22M, 22C and 22B are integrated with the charging devices 24M, 24C and 223 and the cleaners 30M, 30C and 30B as photoreceptor units for respective colors. The developing units 28Y, 28M, 28C and 28B are removably attached to the image forming units 32.

Further, in the image forming unit 32, toner cartridges 34Y, 34M, 34C and 34B as exchangeable units respectively containing toner to be supplied to the developing units 28Y, 28M, 28C and 28B are removably attached to the image forming apparatus main body 12 from a side surface side.

The toner cartridges 34Y, 34M, 34C and 34B have toner cartridge main bodies 35Y, 35M, 35C and 35B. Toner chambers 36Y, 36M, 36C and 36B to collect toner and waste toner chambers 38Y, 38M, 38C and 38B are formed in the toner cartridge main bodies 35Y, 35M, 35C and 35B. The toner is supplied from the toner chambers via a toner supply path 94 provided in the image forming apparatus main body 12 to the developing units 28Y, 28M, 28C and 28B. For example, the toner cartridge 34Y is filled with yellow toner; the toner cartridge 34M is filled with magenta toner; the toner cartridge 34C is filled with cyan toner; and the toner cartridge 34B is filled with black toner.

Note that the toner cartridges 34Y, 34M, 34C and 34B are respectively provided with a residual toner detection sensor or density sensor (not shown), such that the controller 68 can detect (calculate) the respective residual toner amounts.

The transfer unit 42 is provided in contact with the photoreceptors 22Y, 22M, 22C and 22B of the image forming unit 32. The transfer unit 42 has two support rollers 44*a* and 44*b*, a conveyance belt 46 as a conveyance unit to convey a sheet or image, an attachment roller 48 as an attachment unit to attach a sheet to the conveyance belt 46, and transfer rollers 50Y, 50M, 50C and 50B to transfer toner images formed on the respective photoreceptors 22Y, 22M, 22C and 22B onto a sheet being conveyed with the conveyance belt 46, integrated as one unit.

The attachment roller 48 is provided in press-contact with the support roller 44*a* via the conveyance belt 46. When a voltage is applied to the attachment roller 48 from the power source unit 16, the attachment roller 48 electrostatically attaches a sheet to the conveyance belt 46.

The transfer rollers 50Y, 50M, 50C and 50B, respectively receive a transfer bias, and sequentially transfer toner images formed on the photoreceptors 22Y, 22M, 22C and 22B onto a sheet being conveyed with the conveyance belt 46, thus form a color toner image by overlaying yellow, magenta, cyan and black toner images on the sheet.

A fixing device 52 to fix a toner image transferred with the transfer unit 42 to a sheet, onto the sheet, is provided in an upper part of the image forming apparatus main body 12. The fixing device 52 having a heating roller 52*a* and a pressure roller 52*b* fixes the toner image to the sheet by heating and pressing the sheet passing between the heating roller 52*a* and the pressure roller 52*b*.

Further, a conveyance path 60 to convey a sheet fed from the sheet feeder 54 to the sheet discharge part 15 is provided inside the image forming apparatus main body 12. Registration rollers 62, the transfer unit 42, the fixing device 52 and discharge rollers 64 are provided along the conveyance path 60, sequentially from the upstream side of a sheet conveyance direction. The discharge rollers 64 discharge a sheet conveyed from the fixing device 52 to the sheet discharge part 15.

The image forming apparatus main body 12 has a user interface (UI) part 70 in its front side upper position, and an open-close cover 72 to be described later as a moving member to open/close an opening 78 (see FIG. 3) on its one side surface. The UI part 70 which is a touch panel or the like, receives an operator's input and outputs it to the controller 68, and produces predetermined display in accordance with control of the controller 68. The open-close cover 72 is provided with an open-close lever 74 on its outer surface. The open-close lever 74 is held by the operator to open/close the open-close cover 72, and is circular-moved in a forward/reverse direction about an e.g. an up-and-down direction, thereby a hook 76 provided toward inside the image forming apparatus main body 12 is circular-moved in a forward/reverse direction in accordance with the circular motion of the open-close lever 74. The hook 76 is engaged with the image forming apparatus main body 12 in accordance with the forward/reverse circular motion, thereby a closed status of the open-close cover 72 is kept. When the engagement between the hook 76 and the image forming apparatus main body 12 is released, the open-close cover 72 is opened.

Figure 3:
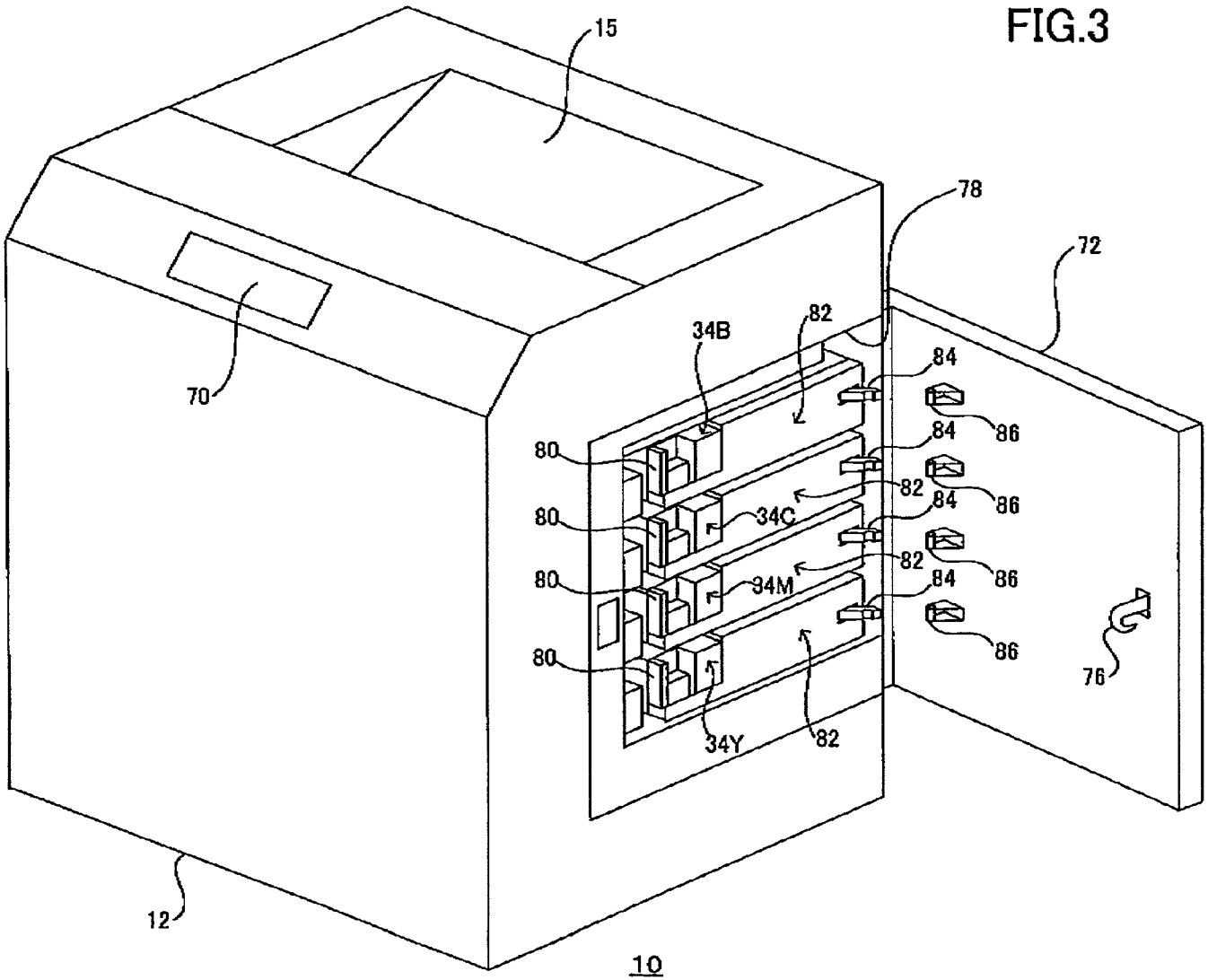
FIG. 3 is a perspective view showing an open-close cover in an opened status of the image forming apparatus according to the exemplary embodiment of the present invention.

FIG. 3 shows the image forming apparatus 10 in which the open-close cover 72 is opened. When the open-close cover 72 is opened, a part of each of the toner cartridges 34Y, 34M, 34C and 34B on the front side (left and front side in FIG. 3) is exposed via the opening 78 on one side surface of the image forming apparatus main body 12. The toner cartridges 34Y, 34M, 34C and 34B are respectively provided with a grip part 80 on the front side, and respectively held with a cartridge holder 82 such that their side surfaces are positioned opposite to the open-close cover 72 when the open-close cover 72 is closed.

Each cartridge holder 82 has an engagement claw 84 projected from the rear surface side of its side surface opposite to the open-close cover 72 when the open-close cover 72 is closed. Each engagement claw 84 is engaged with an engaged member 86 provided inside the open-close cover 72 in a predetermined case to be described later, thereby the cartridge holder 82 is connected with the open-close cover 72.

Note that the toner cartridges 34M, 34C and 34B have the same structure as that of the toner cartridge 34Y except that the colors of toner contained in the toner cartridges 34M, 34C and 34B are different from that contained in the toner cartridge 34Y. Accordingly, the toner cartridge 34Y will be described below.

Figure 4:
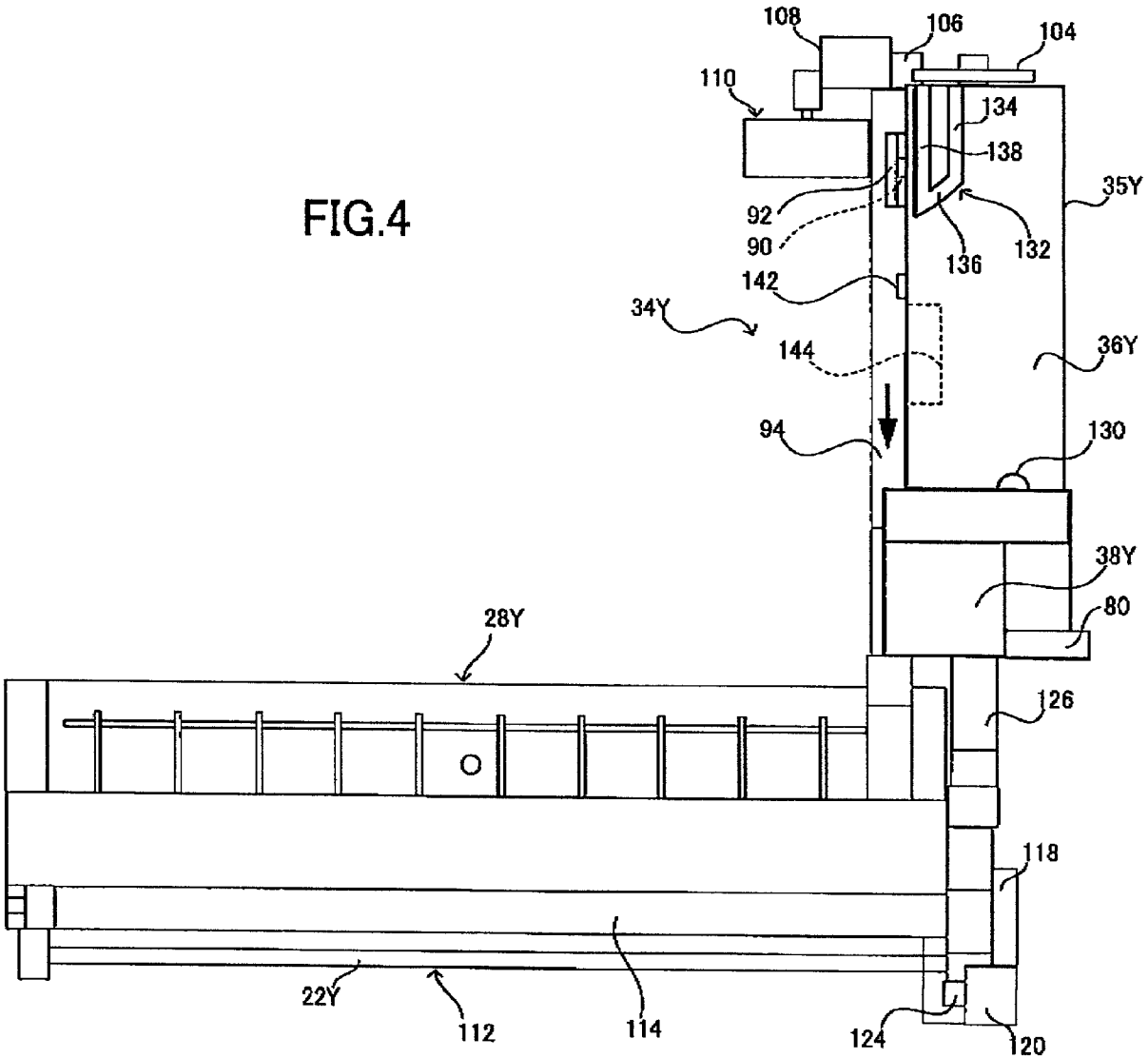
FIG. 4 is a top plan view showing a toner cartridge connected to a developing unit and a peripheral portion of the toner cartridge.
Figure 5:
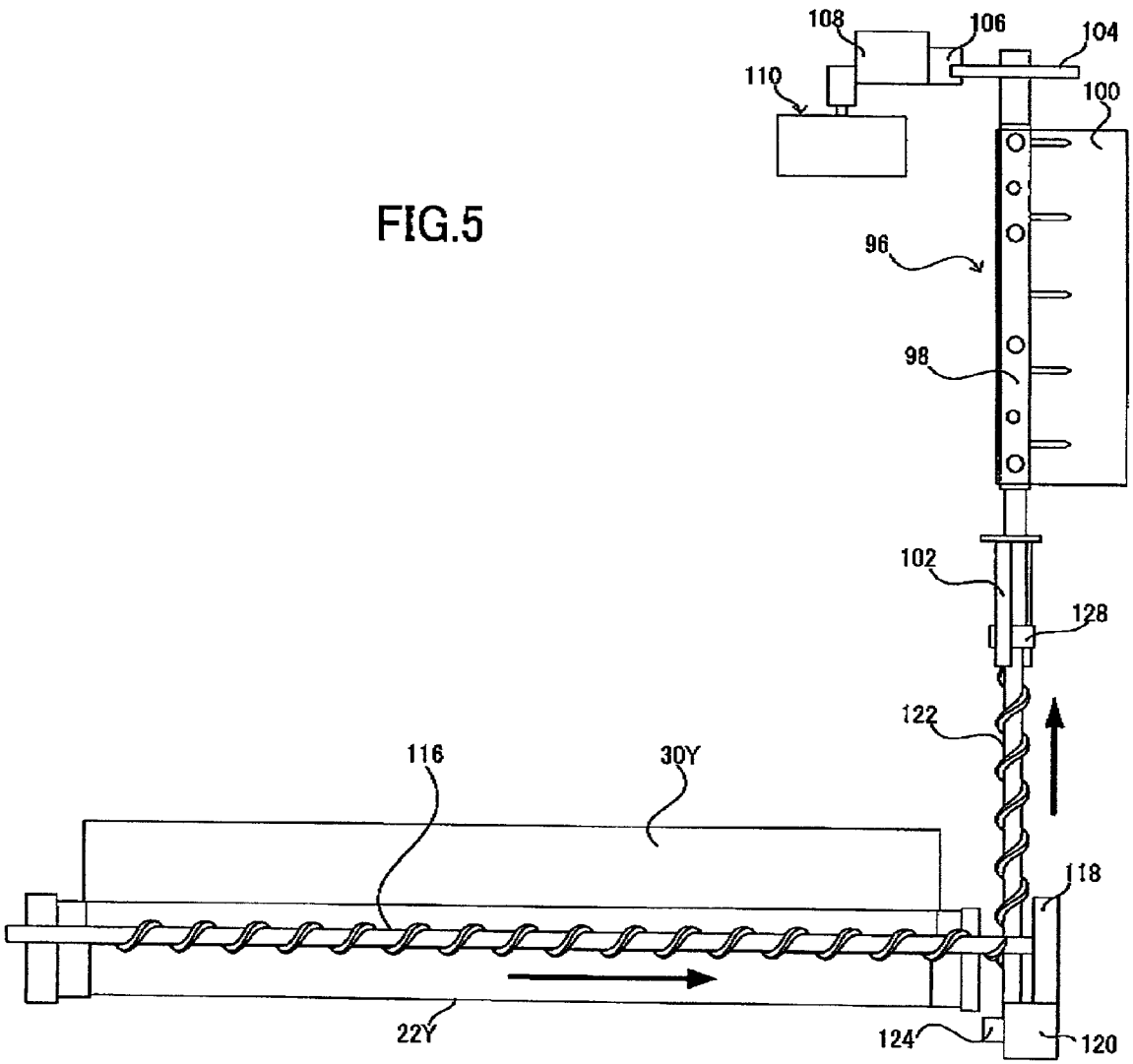
FIG. 5 is a top plan view showing a driving system for the toner cartridge and the peripheral portion of the toner cartridge.
Figure 6:
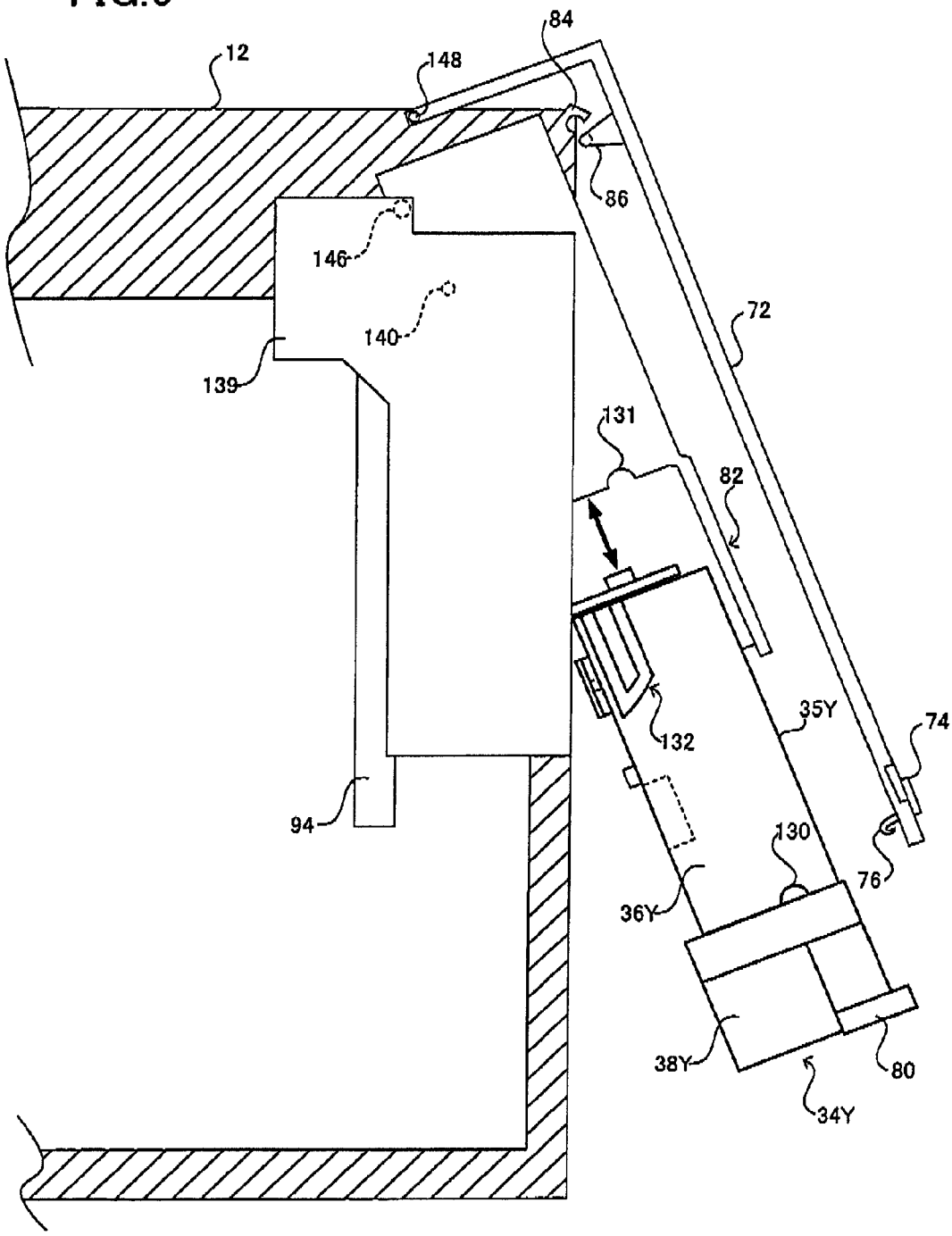
FIG. 6 is a cross-sectional view showing the toner cartridge removed from a cartridge holder and the peripheral portion of the toner cartridge, viewed from an upper position.

FIGS. 4 to 6 show the toner cartridge 34Y and its peripheral portion.

In the toner cartridge 34Y, the toner chamber 36Y and the waste toner chamber 38Y partitioned from each other are arrayed in a lengthwise direction. The toner chamber 36Y is provided with a toner supply port 90 as an opening formed on an inner side surface, and a cartridge shutter 92 as an opening-closing member movable in approximately parallel with a side surface of the toner chamber 36Y to open/close the toner supply port 90. The toner chamber 36Y is connected via the toner supply path 94 to the developing unit 28Y.

Further, the toner chamber 36Y is provided with a stir-conveyance member 96 which stirs toner contained in the toner chamber 36Y. The stir-conveyance member 96 rotates a film 100 attached to a shaft 98, thereby stirs the toner and conveys the toner to the toner supply port 90. A connection part 102 is provided at one end of the shaft 98. The connection part 102, with a connection part 128 to be described later, forms a coupling, to transmit rotation of the shaft 98. A driving gear 104 is fixed on the opposite side of the shaft 98 to the connection part 102. The driving gear 104 is rotated with a driving force of a motor 110 transmitted via gears 106 and 108. That is, when the gear 106 is rotated with the driving force of the motor 110, the toner in the toner chamber 36Y is conveyed to the toner supply path 94, and is supplied to the developing unit 28Y with a toner conveyance member (not shown) in the toner supply path 94.

The photoreceptor unit 112 includes the photoreceptor 22Y, the charging device 24Y, the cleaner 30Y and the like, and has a waste toner conveyance path 114 in its upper part. The waste toner conveyance path 114 has a waste toner conveyance member 116 to convey waste toner collected with the cleaner 30. The waste toner conveyance member 116 has a driving gear 118 fixed to its one end, and conveys the waste toner toward the driving gear 118 side by rotation of the driving gear 118. The driving gear 118 is rotated with a driving force of a gear 124 fixed to one end of a waste toner conveyance member 122 via a gear 120.

The waste toner conveyance member 122 is provided in the waste toner conveyance path 126 extending a direction approximately orthogonal to the waste toner conveyance member 116. The waste toner conveyance member 122 conveys the waste toner conveyed with the waste toner conveyance member 116 toward the side opposite to the gear 124. Further, the connection part 128 is provided on one side of the waste toner conveyance member 122 opposite to the gear 124. When the driving gear 104 is rotated with the driving force of the motor 110, the driving force is transmitted via the shaft 98 and the connection parts 102 and 128 to the waste toner conveyance member 122. The driving force is transmitted via the gears 124 and 120 and the driving gear 118 to the waste toner conveyance member 116. The waste toner collected with the cleaner 30Y is collected through waste toner conveyance paths 114 and 126, and via a waste toner reception port (not shown), into the waste toner chamber 38Y.

Further, a positioning member 130 is provided around a position between the waste toner chamber 38Y and the toner chamber 36Y on an upper surface of the toner cartridge 34Y, and an engagement groove 132 is provided on the rear surface side (upper side in FIG. 4). The positioning member 130 is engaged with an positioning groove 131 provided on the upper front side of the cartridge holder 82, thereby positioning of the toner cartridge 34Y is made with respect to the cartridge holder 82.

The engagement groove 132 has a first groove 134, a second groove 136 and a third groove 138. The engagement groove 132 is in contact with a boss 140 projecting downward from a lower surface of the top plate 139 provided above the cartridge holder 82 in a status where the boss 140 is slid in the engagement groove 132. The top plate 139 is a part of the image forming apparatus main body 12.

Further, a projection 142 to open/close a supply path shutter 156 to be described later and an engagement hole 144 with which a moving piece 178 to be described later is engaged are provided on an inner side surface of the toner cartridge 34Y.

Note that the cartridge holder 82 is circular-moved about a shaft 146 shown in FIG. 6 in a forward/reverse direction with respect to the image forming apparatus main body 12. Further, the open-close cover 72 is circular-moved about a shaft 148 in a forward/reverse direction with respect to the image forming apparatus main body 12. As the cartridge holder 82 is circular-moved in the forward/reverse direction in accordance with opening/closing of the open-close cover 72 in the predetermined case to be described later, the operator can move the toner cartridge 34Y held in the cartridge holder 82 in accordance with the opening/closing of the open-close cover 72 and can attach/remove the toner cartridge 34Y to/from the image forming apparatus main body 12 in a lengthwise direction.

Next, a mechanism for attachment/removal of the toner cartridge 34Y (34M, 34C and 34B) will be described in detail.

Figure 7:
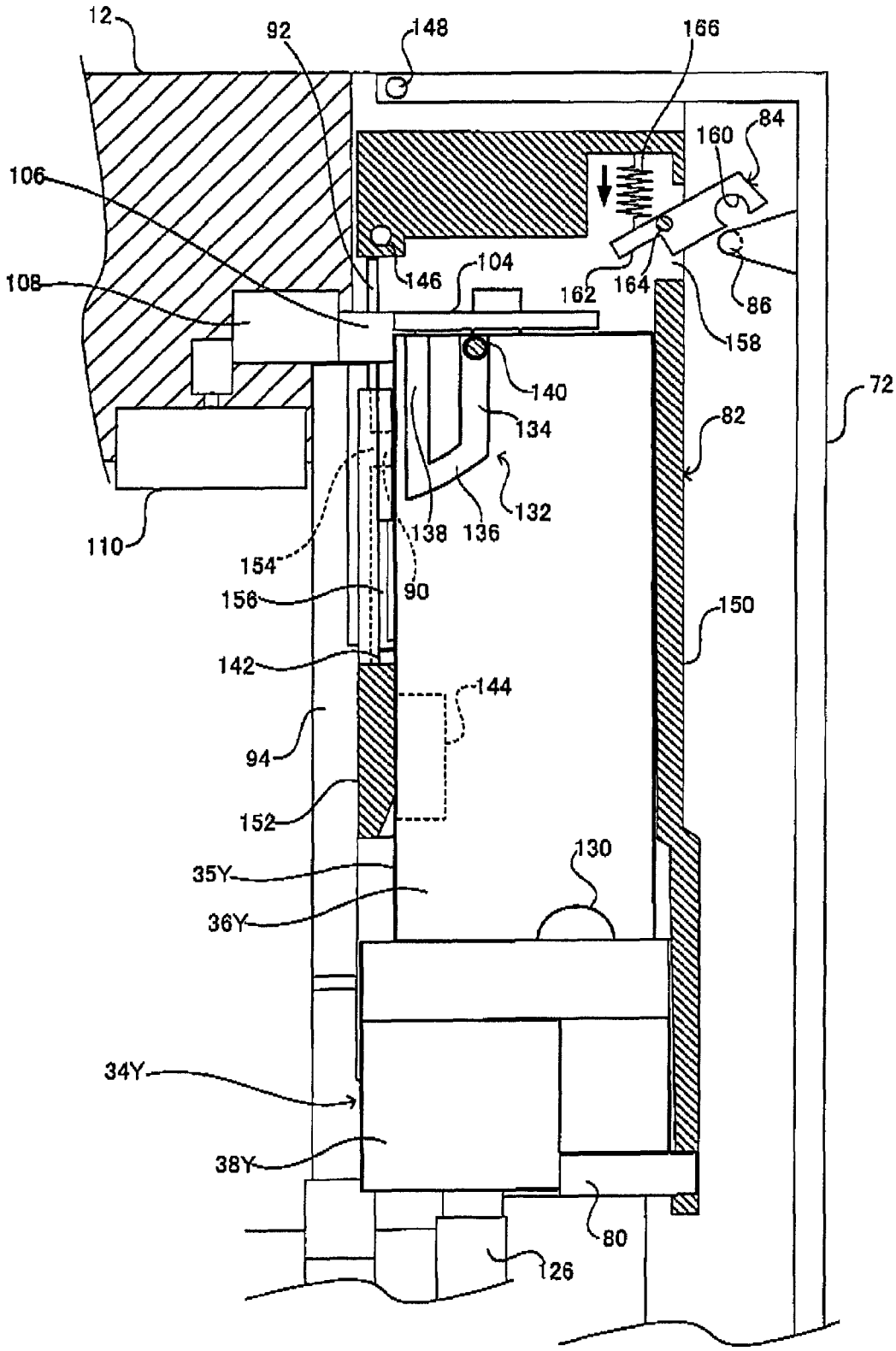
FIG. 7 is a cross-sectional view showing the toner cartridge attached to an image forming apparatus main body, viewed from the upper position.

FIG. 7 is a cross-sectional view showing the toner cartridge 34Y attached to the image forming apparatus main body 12, viewed from an upper position.

The toner cartridge 34Y is held with a first side surface 150 forming an outer side surface of the cartridge holder 82, a second side surface 152 forming an inner side surface of the cartridge holder 82 and a bottom surface, and provided such that the waste toner chamber 36Y is connected with the waste toner conveyance path 126.

The boss 140 is positioned on the driving gear 104 side in the first groove 134, regulating movement of the toner cartridge 34Y in a shorter direction of the first groove 134.

Further, the supply path shutter 156, which is movable in the lengthwise direction of the toner supply path 94 to open/close the toner reception port 154 provided in the toner supply path 94, is moved to the front surface side (lower side in FIG. 7) with an end of the toner supply port 90, to open the toner reception port 154. A projection (not shown) provided on the image forming apparatus main body 12 side regulates movement of the cartridge shutter 92 toward the front surface side and the rear surface side, and the cartridge shutter 92 opens/closes the toner supply port 90 of the toner cartridge 34Y. The toner supply port 90 is positioned opposite to the toner reception port 154. The toner in the toner chamber 36Y is supplied to the toner supply path 94 with the above-described stir-conveyance member 96.

The engagement claw 84 is projected from inside the cartridge holder 82 via an opening 158 provided on the rear surface side of the first side surface 150. A groove 160 to be engaged with the engaged member 86 is provided outside the cartridge holder 82, and a notch 162 to be engaged with an end of the toner cartridge 34Y is formed inside the cartridge holder 82. Thus the engagement claw 84 is circular-movable about a shaft 164 in a forward/reverse direction. Further, a pressing member 166 such as a spring is provided on the notch 162 side of the engagement claw 84. The pressing member 166 presses the notch 162 toward the front surface side, thereby the engagement between the engagement claw 84 and the engaged member 86 is released in a status where the toner cartridge 34Y is attached to the image forming apparatus main body 12.

Figure 8:
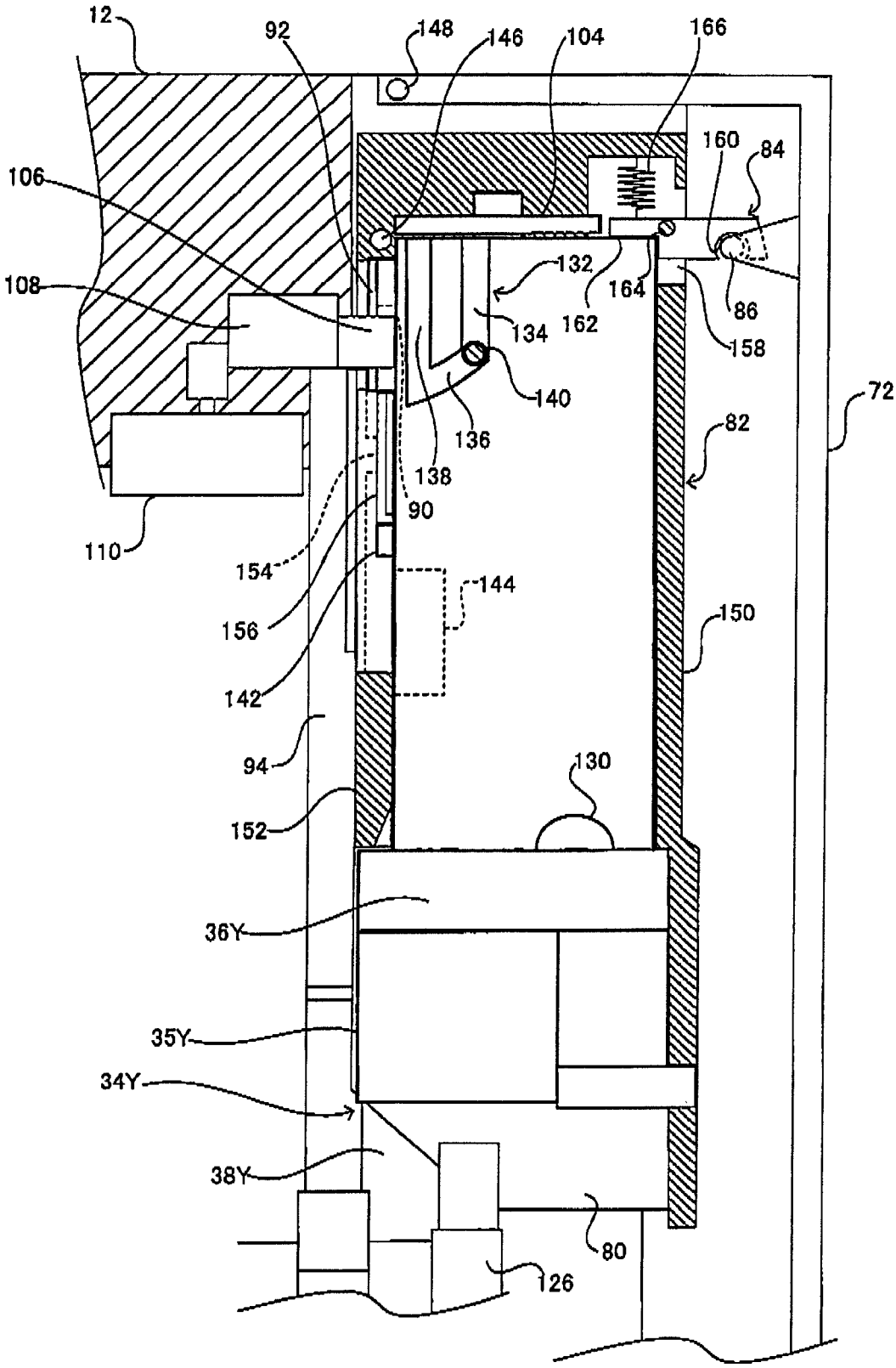
FIG. 8 is a cross-sectional view showing the toner cartridge moved so as to close a toner supply port with a cartridge shutter, viewed from the upper position.

FIG. 8 is a cross-sectional view showing the toner cartridge 34Y moved so as to close the toner supply port 90 with the cartridge shutter 92, viewed from the upper position.

The toner cartridge 34Y, held from both side surfaces with the first side surface 150 and the second side surface 152, is moved to the rear surface side (upper side in FIG. 8) such that the waste toner chamber 38Y is moved away from the waste toner conveyance path 126, with the moving piece 178 (to be described later using FIGS. 11 and 12) engaged with the engagement hole 144.

The boss 140 is positioned in a connection portion between the first groove 134 and the second groove 136, thereby regulating the movement of the toner cartridge 34Y in the lengthwise direction of the cartridge holder 82, with the first side surface 150 and the second side surface 152. Note that since the boss 140 is in contact with the second groove 136 such that the boss is slid in the groove, the circular movement of the toner cartridge 34Y in the forward/reverse direction about the shaft 146 is enabled.

The supply path shutter 156 is moved with the projection 142 to a position to cover the toner reception port 154. The toner supply port 90 is moved to a position to be covered with the cartridge shutter 92. That is, the toner is not leaked from any of the toner reception port 154 and the toner supply port 90.

As the end of the toner cartridge 34Y is engaged with the notch 162, the engagement claw 84 is rotated about the shaft 164 in a right-hand direction (clockwise in FIG. 8) against the pressure by the pressing member 166, and the groove 160 is engaged with the engaged member 86. That is, the cartridge holder 82 and the open-close cover 72 are connected with each other.

Figure 9:
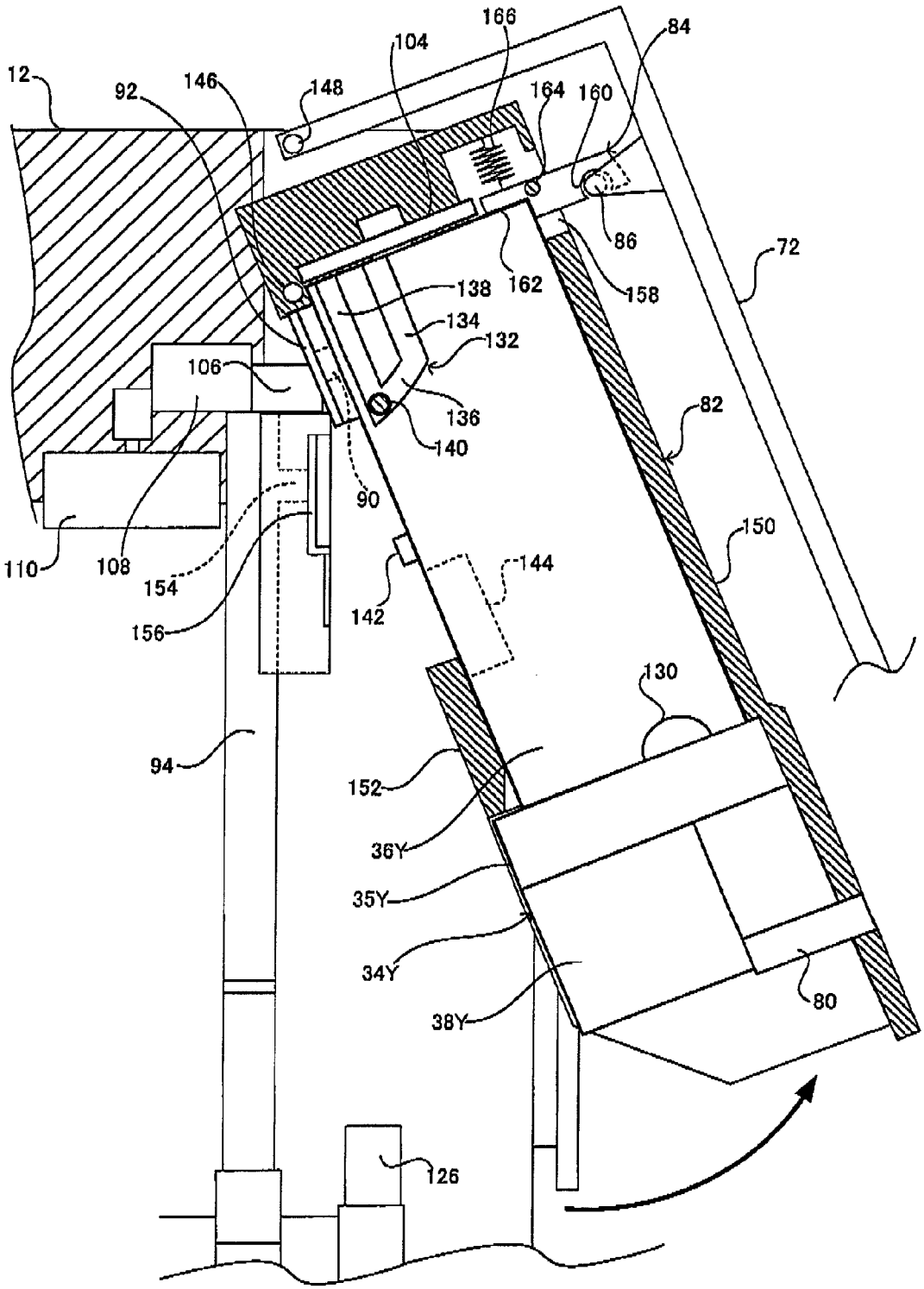
FIG. 9 is a cross-sectional view showing the toner cartridge moved in accordance with an operation to open the open-close cover, viewed from the upper position.

FIG. 9 is a cross-sectional view showing the toner cartridge 34Y moved in accordance with an operation to open the open-close cover 72, viewed from the upper position.

As the end of the toner cartridge 34Y is engaged with the notch 162, the cartridge holder 82 and the open-close cover 72 are connected with each other. Accordingly, when the operator opens the open-close cover 72, the toner cartridge 34Y is moved, while being held in the cartridge holder 82, in accordance with the movement of the open-close cover 72.

Note that as the second groove 136 is slide-moved in contact with the boss 140, the toner cartridge 34Y is circular-moved about the shaft 146, and regulated from moving in the lengthwise direction of the cartridge holder 82.

When the toner cartridge 34Y is moved in accordance with the opening/closing of the open-close cover 72, as the toner reception port 154 is covered with the supply path shutter 156, and the toner supply port 90 is covered with the cartridge shutter 92, the toner is not leaked from any of the toner reception port 154 and the toner supply port 90. Further, when the toner cartridge 34Y is pulled out in the middle of its rotation (in a transitional status between the status in FIG. 8 and that in FIG. 9), the supply path shutter 156 and the cartridge shutter 92 interfere with each other and are opened. However, as the toner cartridge 34Y is regulated with the second groove 136 and the boss 140 from moving in the lengthwise direction of the cartridge holder 82, the supply path shutter 156 or the cartridge shutter 92 is not opened and toner leakage can be prevented when the toner cartridge 34Y is pulled out in the middle of its rotation.

Figure 10:
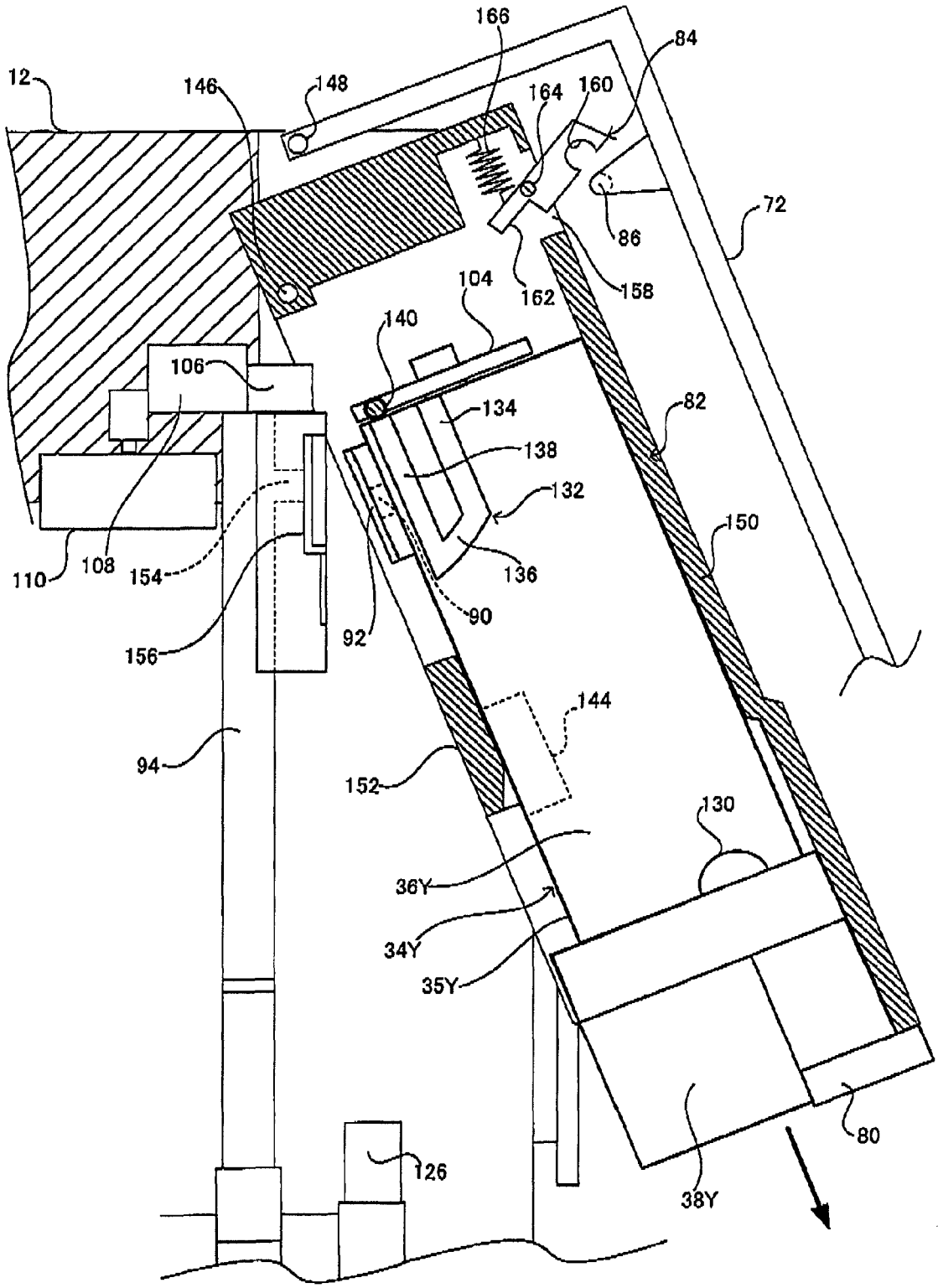
FIG. 10 is a cross-sectional view showing the toner cartridge being moved away from the cartridge holder, viewed from the upper position.

FIG. 10 is a cross-sectional view showing the toner cartridge 34Y being moved away from the cartridge holder 82, viewed from the upper position.

When the toner cartridge 34Y is pulled out in sideways on the front surface side (lower side in FIG. 10) by the operator holding the grip part 80, the toner cartridge 34Y is removed from the cartridge holder 82 while it is held from the both sides with the first side surface 150 and the second side surface 152.

Note that as the third groove 138 is slide-moved in contact with the boss 140, the toner cartridge 34Y is moved approximately straight in the lengthwise direction of the cartridge holder 82.

When the toner cartridge 34Y is removed from the cartridge holder 82, as the toner reception port 154 is covered with the supply path shutter 156 and the toner reception port 90 is covered with the cartridge shutter 92, the toner is not leaked from either of the toner reception port 154 and the toner supply port 90.

Further, the end of the toner cartridge 34Y and the notch 162 are not engaged with each other, and the engagement claw 84 is rotated about the shaft 164 in a left-hand direction (counterclockwise in FIG. 10) by the pressure by the pressing member 166. The engagement between the engagement claw 84 and the engaged member 86 is released.

Figure 11:
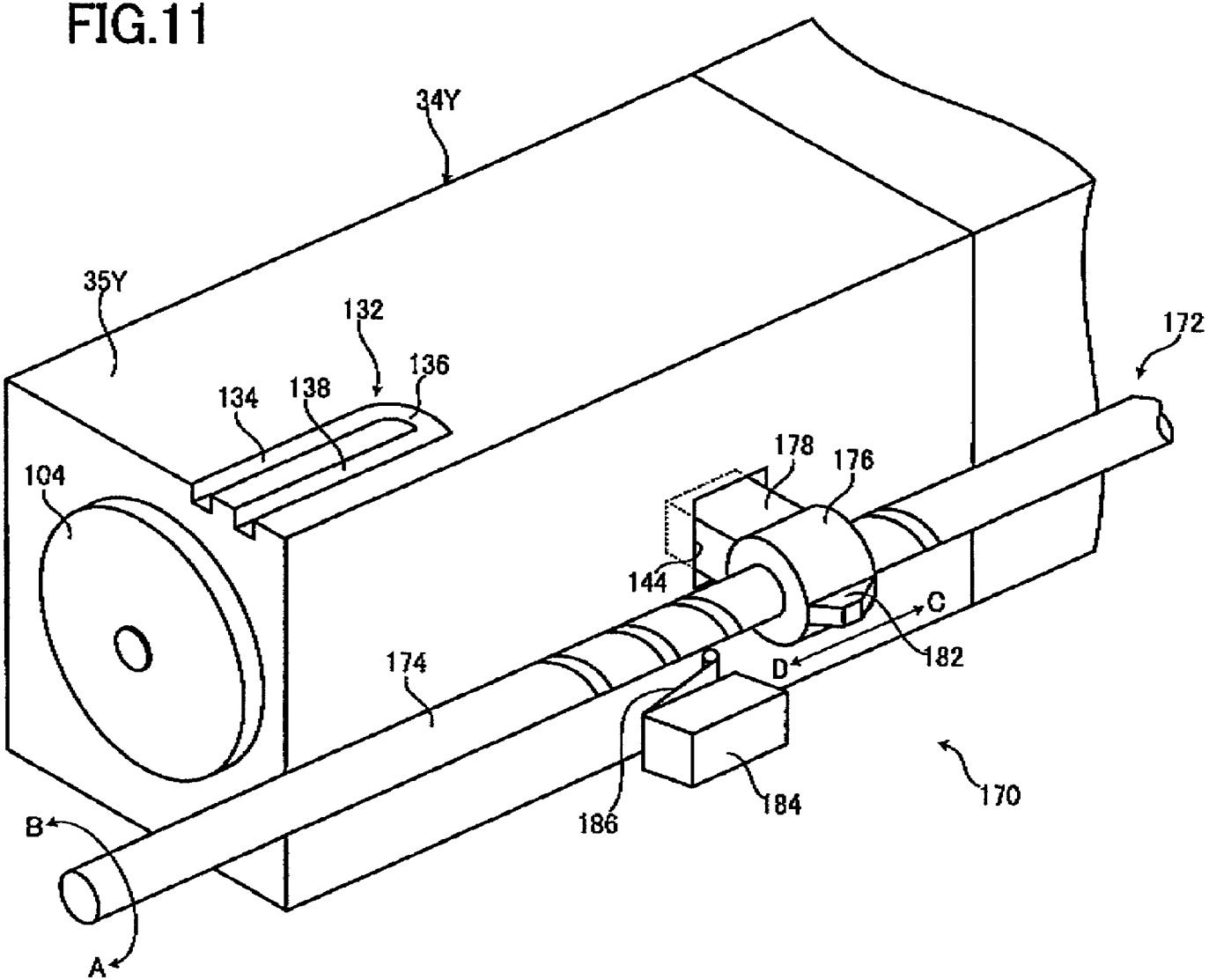
FIG. 11 is a perspective enlarged view of a mechanism to move the toner cartridge inside the cartridge holder (status where a moving piece is engaged with an engagement hole)
Figure 12:
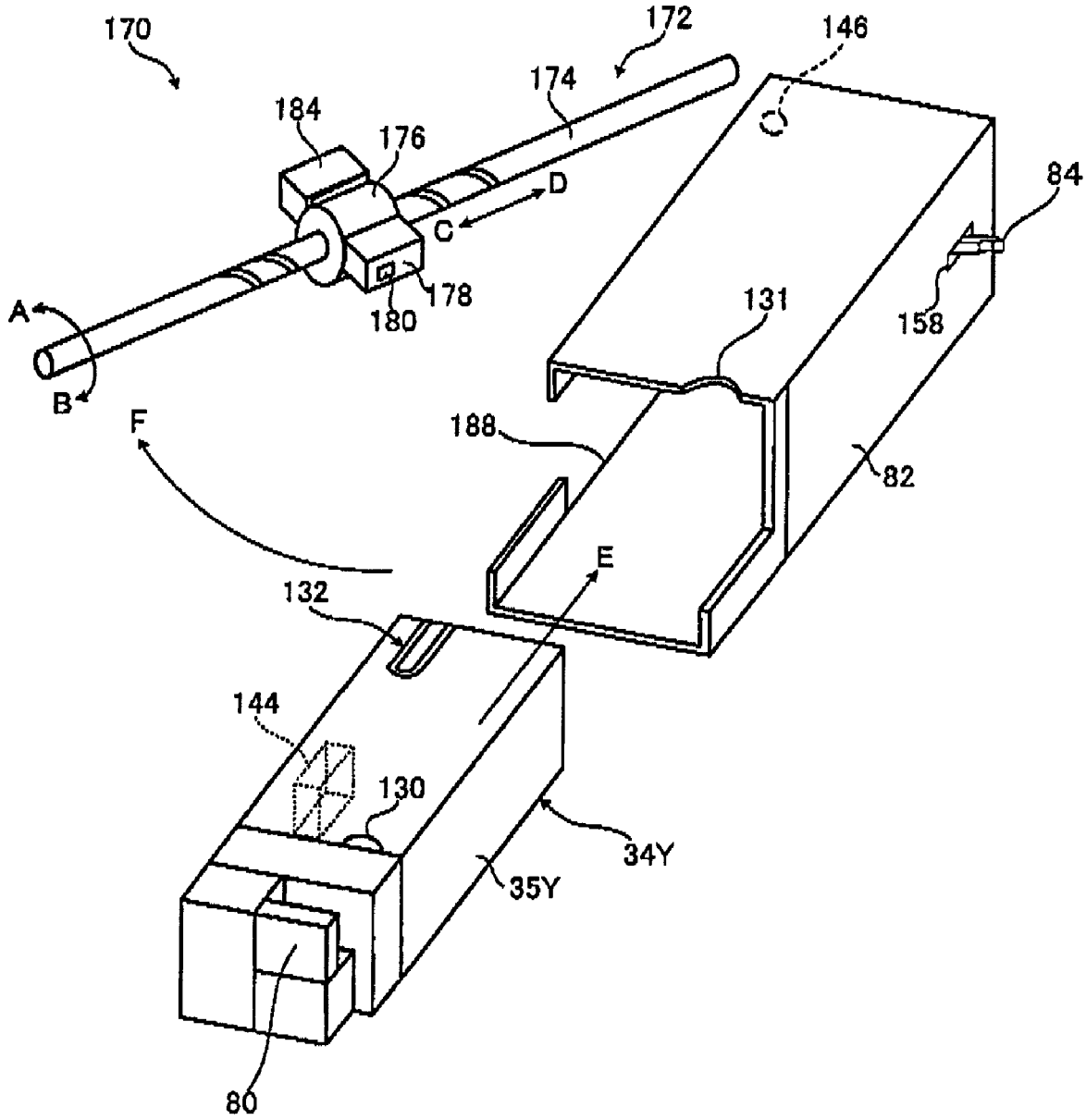
FIG. 12 is a perspective exploded view showing a structure of the mechanism to move the toner cartridge inside the cartridge holder.

FIGS. 11 and 12 show a mechanism to move the toner cartridge 34Y in the cartridge holder 82 (cartridge moving mechanism 170).

As shown in FIG. 11, the cartridge moving mechanism 170 has a ball screw 172. The ball screw 172 has a screw shaft 174 rotatably provided in the image forming apparatus main body 12 and a nut 176 provided movably in an axial direction of the screw shaft 174. The screw shaft 174 is connected to a ball screw driver (not shown). The nut 176 is moved in the axial direction of the screw shaft 174 (arrow C direction in FIG. 11) by forward rotation of the screw shaft 174 (rotation in arrow A direction in FIG. 11), and the nut 176 is moved in the axial direction of the screw shaft 174 (arrow D direction in FIG. 11) by reverse rotation of the screw shaft 174 (rotation in arrow B direction in FIG. 11).

The nut 176 has the moving piece 178. The moving piece 178 is disengageably engaged with the engagement hole 144 formed in the toner cartridge 34Y. That is, when the moving piece 178 of the ball screw 172 is engaged with the engagement hole 144 of the toner cartridge 34Y, the ball screw 172 can move the toner cartridge 34Y in the axial direction of the screw shaft 174 (arrow C and arrow D directions in FIG. 11). In this manner, the moving piece 178 and the engagement hole 144 are used as an engagement unit to disengageably engage the toner cartridge with the ball screw 172.

A cartridge sensor 180, provided on the moving piece 178, is electrically connected to the controller 68. The cartridge sensor 180 outputs a detection signal to the controller 68 when the moving piece 178 is engaged with the engagement hole 144 of the toner cartridge 34Y. Further, the nut 176 has a convex member 182 which is brought into contact with a detection member 186 of a position sensor 184 to be described later when the nut 176 has been moved to a predetermined position.

The position sensor 184 as a position detection unit, having e.g. a micro switch, is provided in a predetermined position of the image forming apparatus main body 12 and is electrically connected to the controller 68. The position sensor 184 has the detection member 186. When the detection member 186 and the convex member 182 of the nut 176 are brought into contact, the position sensor 184 outputs a detection signal to the controller 68. The position sensor 184 detects that the toner cartridge 34Y is in an exchange position (position shown in FIG. 8) where the cartridge is exchanged with new one in a status where the open-close cover 72 is closed.

As shown in FIG. 12, the cartridge holder 82 has a holder opening 188 in its surface opposite to the cartridge moving mechanism 170.

When the toner cartridge 34Y is attached in the image forming apparatus main body 12, the toner cartridge 34Y is inserted into the cartridge holder 82 (arrow E direction in FIG. 12), then the cartridge holder 82 to which the toner cartridge 34Y is attached is rotated (arrow F direction in FIG. 12) about the shaft 146, thereby the engagement hole 144 of the toner cartridge 34Y and the moving piece 178 of the ball screw 172 are engaged with each other via the holder opening 188. Then, the screw shaft 174 of the ball screw 172 is forward-rotated (arrow A direction in FIG. 12), thereby the toner cartridge 34Y is moved in the axial direction of the screw shaft 174 (arrow C direction in FIG. 12) to a position where the toner supply port 90 and the toner reception port 154 face to each other (attachment position).

In this manner, the toner cartridge 34Y is moved approximately straight in the cartridge holder 82 by the forward/reverse rotation of the screw shaft 174.

Figure 13:
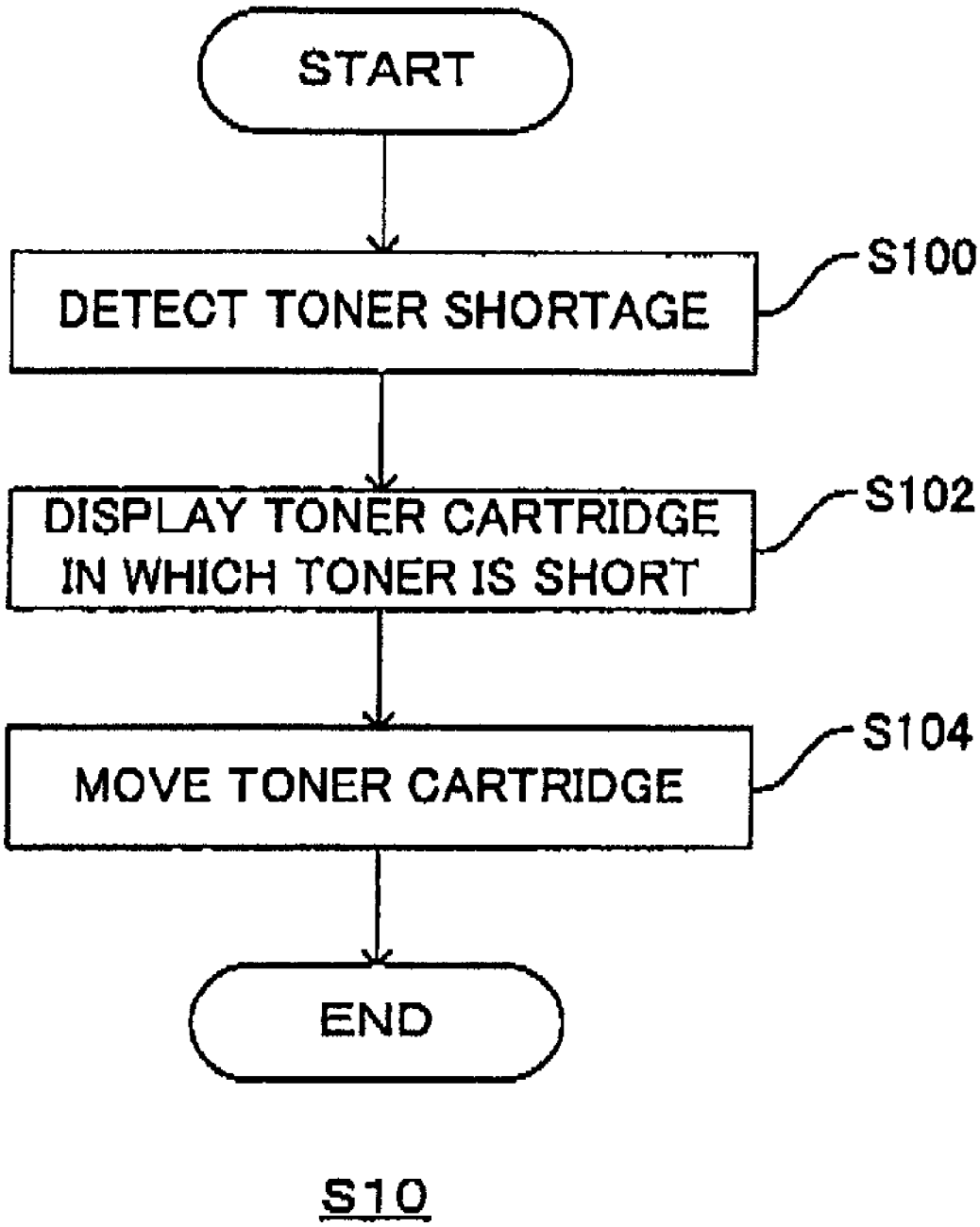
FIG. 13 is a flowchart showing an example of an operation (S10) of the image forming apparatus to remove at least one of the toner cartridges so as to be exchanged with new one.

FIG. 13 is a flowchart showing an example of an operation (S10) of the image forming apparatus 10 to remove at least one of the toner cartridges 34Y, 34M, 34C and 34B so as to be exchanged with new one.

As shown in FIG. 13, at step S100, the controller 68 detects toner shortage in at least one of the toner cartridges 34Y, 34M, 34C and 34B.

At step S102, the UI part 70 displays information specifying at least one of the toner cartridges 34Y, 34M, 34C and 34B in which toner shortage has been detected by the processing at step S100, in accordance with the control by the controller 68.

For example, when toner shortage in the toner cartridge 34Y has been detected, the UT part 70 displays information indicating that the toner shortage in the toner cartridge 34Y has been detected.

At step S104, the controller 68 moves any one of the toner cartridges 34Y, 34M, 34C and 34B specified by the processing at step S102 via the ball screw 172.

For example, when toner shortage in the toner cartridge 34Y has been detected, the controller 68 moves the toner cartridge 34Y to the rear surface side, thereby releases the connection between the toner cartridge 34Y and the developing unit 28Y, and connects the cartridge holder 82 holding the toner cartridge 34Y to the open-close cover 72.

Accordingly, the operator can easily exchange the toner cartridge 34Y, in which toner shortage has been detected, with new one, by opening the open-close cover 72.

Figure 14:
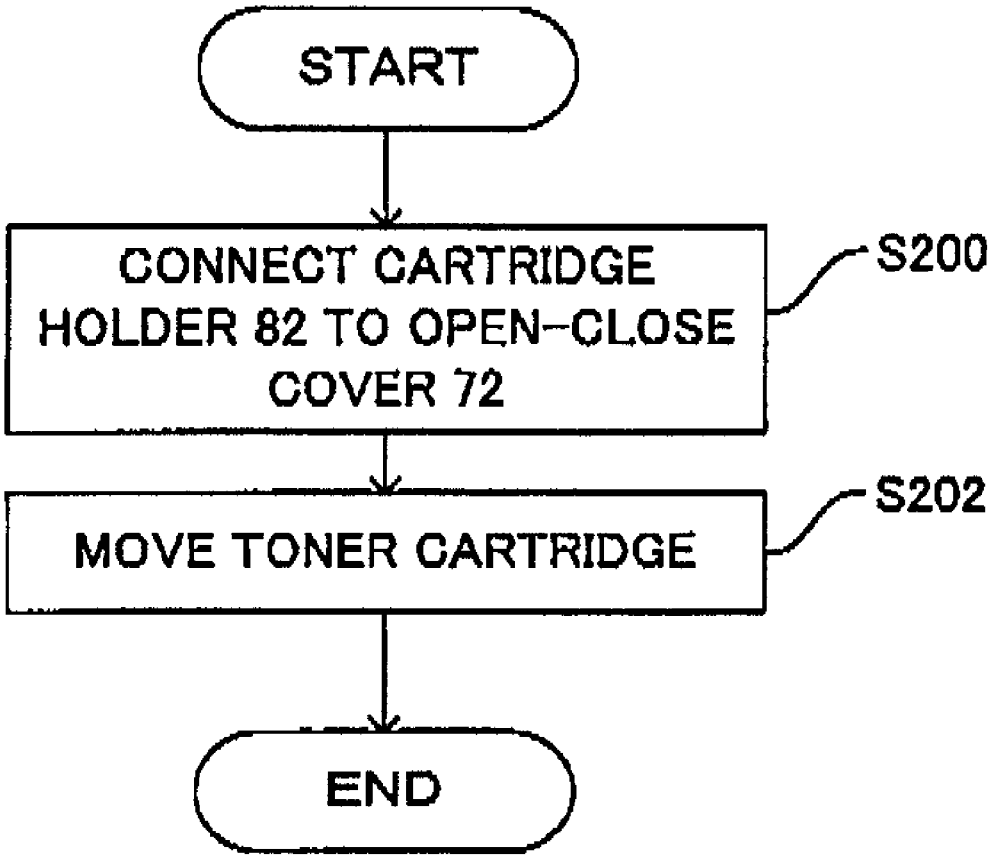
FIG. 14 is a flowchart showing an example of an operation (S20) of the image forming apparatus when the toner cartridge is attached to the image forming apparatus main body.

FIG. 14 is a flowchart showing an example of an operation (S20) of the image forming apparatus 10 when the toner cartridge 34Y, e.g., is attached to the image forming apparatus main body 12.

As shown in FIG. 14, at step S200, in the engagement claw 84 of the cartridge holder 82 into which the toner cartridge 34Y has been inserted by the operator, the end of the toner cartridge 34Y is engaged with the notch 162, thereby the groove 160 is engaged with the engaged member 86. That is, the cartridge holder 82 in which the toner cartridge 34Y has been inserted is connected to the open-close cover 72, and the toner cartridge 34Y can be moved in accordance with the closing of the open-close cover 72.

At step S202, when the position sensor 184 detects that the toner cartridge 34Y is in the exchange position to be exchanged with new one (the position shown in FIG. 8) in a status where the open-close cover 72 is closed, the controller 68 moves the toner cartridge 34Y to the front surface side via the ball screw 172, thereby releases the connection between the cartridge holder 82 holding the toner cartridge 34Y and the open-close cover 72, and connects the toner cartridge 34Y to the developing unit 28Y.

Accordingly, the operator can easily attach the toner cartridge 34Y to the image forming apparatus main body 12 by closing the open-close cover 72.

Next, a modification of the cartridge holder 82, the toner cartridge 34Y and the peripheral portion of the toner cartridge will be described.

Figure 15:
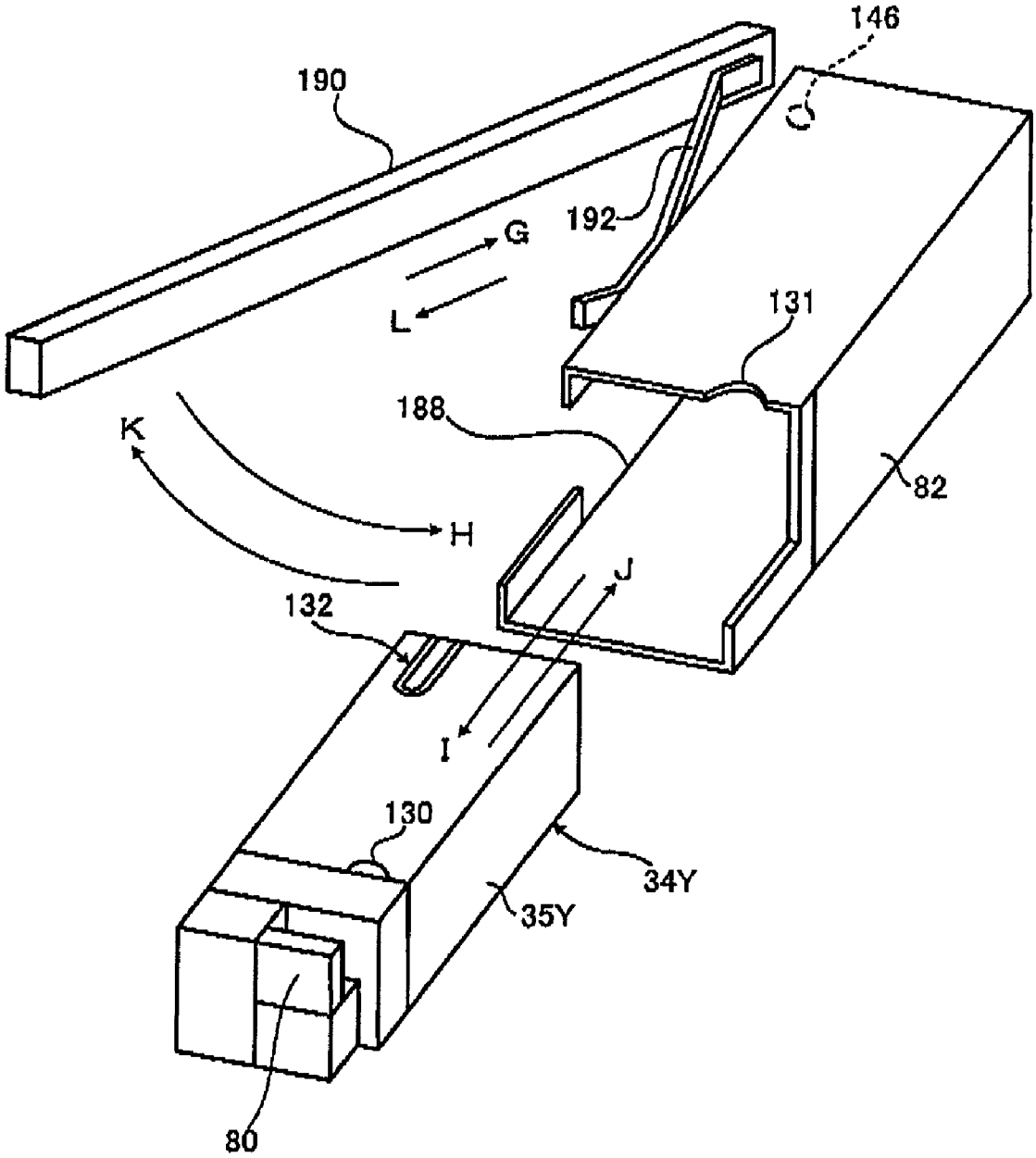
FIG. 15 is a perspective exploded view showing a modification of the cartridge holder, the toner cartridge and the peripheral portion of the toner cartridge.
Figure 16:
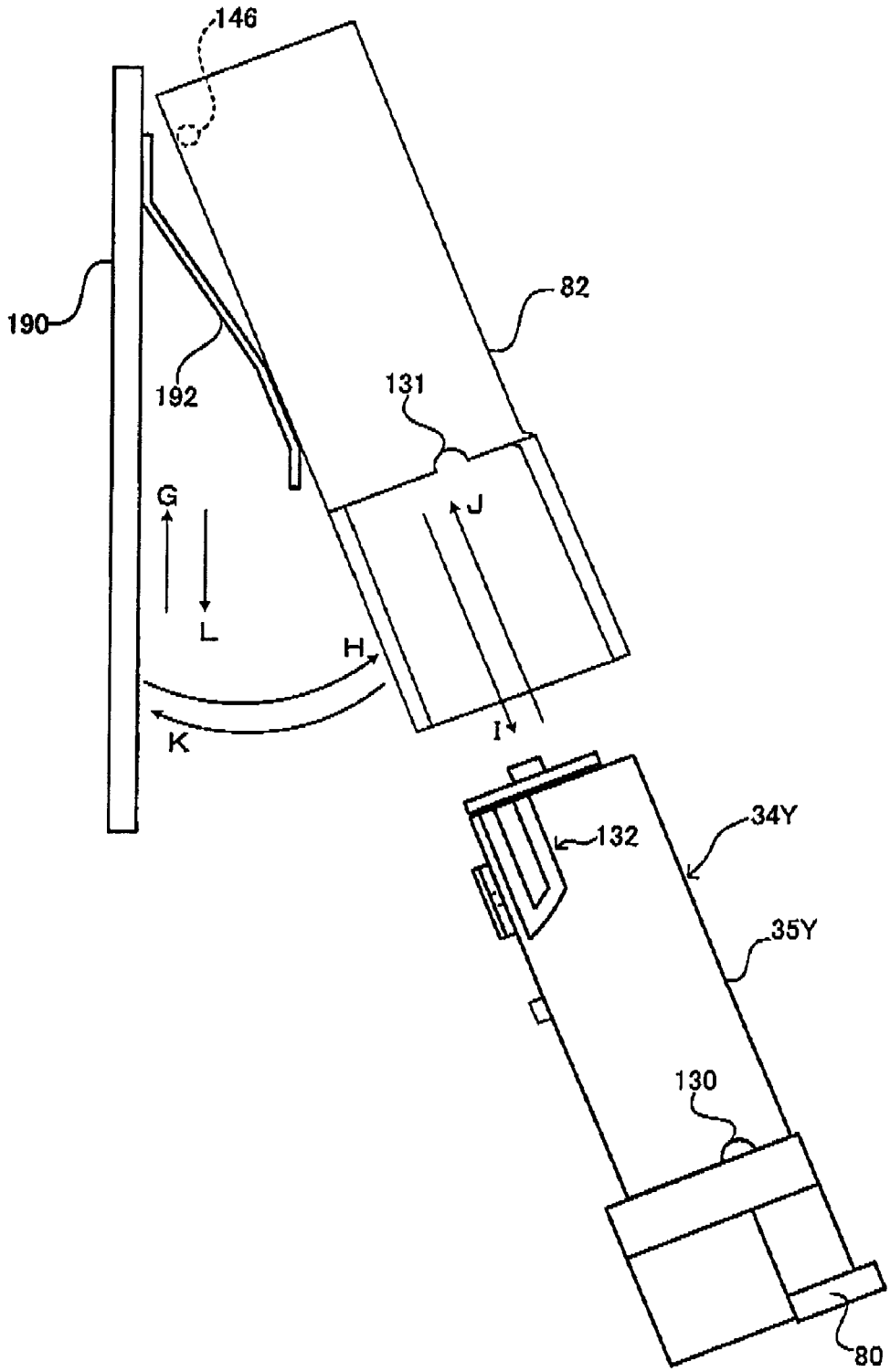
FIG. 16 is a plan view of the modification of the cartridge holder, the toner cartridge and the peripheral portion of the toner cartridge, viewed from the upper position.

FIGS. 15 and 16 show the modification of the cartridge holder, the toner cartridge and the peripheral portion of the toner cartridge. Note that in the modification of the cartridge holder 82 and the toner cartridge 34Y, constituent elements substantially the same as those of the cartridge holder 82 and the toner cartridge 34Y shown in FIG. 12 and the other figures have the same reference numerals.

In the modification of the cartridge holder 82, the engagement claw 84 and the opening 158 and the like shown in FIG. 12 and the other figures are not provided. On the other hand, an elastic member 192 such as a plat spring provided on a frame 190 fixed inside the image forming apparatus main body 12 is in contact with an inner side surface of the cartridge holder 82. The elastic member 192 is pressed against the cartridge holder 82 such that the cartridge holder 82 is circular-moved outward about the shaft 146. In the modification of the toner cartridge 34Y, the engagement hole 144 shown in FIG. 12 and the other figures is not provided.

Accordingly, in a case where the modification of the toner cartridge 34Y is removed from the image forming apparatus 10, first, the operator holds the grip part 80 and moves the toner cartridge 34Y to the rear surface side (arrow G direction), thereby releases the connection between the toner cartridge 34Y and the developing unit 28Y (see FIG. 4 and the other figures). When the connection between the toner cartridge 34Y and the developing unit 28Y is released, the cartridge holder 82 is moved, with the toner cartridge 34Y, to the outside (arrow H direction) by the elastic member 192. Then the operator holding the grip part 80 pulls the toner cartridge 34Y out from the cartridge 82 in an arrow I direction, thereby removes the toner cartridge 34Y from the image forming apparatus 10.

Further, in a case where the modification of the toner cartridge 34Y is attached to the image forming apparatus 10, first, the operator inserts the toner cartridge 34Y into the cartridge holder 82 from the engagement groove 132 side in an arrow J direction, then holds the grip part 80 and causes the cartridge holder 82 to hold the toner cartridge 34Y. Then, the operator moves the cartridge holder 82 holding the toner cartridge 34Y inward (arrow K direction) against the pressure by the elastic member 192. Then the operator holds the grip part 80 and moves the toner cartridge 34Y to the front surface side (arrow L direction), to connect the toner cartridge 34Y to the developing unit 28Y, thereby attaches the toner cartridge 34Y to the image forming apparatus 10.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner cartridge which is removably held in a toner cartridge holder that is circular-moved with respect to an image forming apparatus main body, the toner cartridge holder is movable between an attaching position where the toner cartridge held in the toner cartridge holder is attached to an image forming apparatus and a removing position where the toner cartridge is removed from the toner cartridge holder, comprising:

a cartridge main body;

a toner chamber that is provided inside the cartridge main body and contains toner;

an opening that enables movement of the toner between a position inside the toner chamber and a position outside the cartridge main body; and a regulation part that regulates movement of the toner cartridge with respect to the toner cartridge holder when the toner cartridge holder is rotated between the attaching position and the removing position, wherein the regulation part is configured to permit predetermined linear movements and predetermined rotational movements.

2. The toner cartridge according to claim 1, wherein the regulation part regulates the movement of the toner cartridge with respect to the toner cartridge holder by a groove provided in the toner cartridge.

3. The toner cartridge according to claim 1, wherein at least a part of the opening is positioned on a side surface of the cartridge main body.

4. The toner cartridge according to claim 2, wherein at least a part of the opening is positioned on a side surface of the cartridge main body.

5. The toner cartridge according to claim 1, wherein the opening has at least one of a toner supply port to supply the toner and a toner reception port to receive the toner.

6. The toner cartridge according to claim 2, wherein the opening has at least one of a toner supply port to supply the toner and a toner reception port to receive the toner.

7. The toner cartridge according to claim 3, wherein the opening has at least one of a toner supply port to supply the toner and a toner reception port to receive the toner.

8. An image forming apparatus comprising:

an image forming apparatus main body;

an image forming part; and a toner cartridge that contains at least toner supplied to the image forming part or toner received from the image forming part, the toner cartridge is removably held in a toner cartridge holder that is circular-moved with respect to an image forming apparatus main body, the toner cartridge holder is movable between an attaching position where the toner cartridge held in the toner cartridge holder is attached to an image forming apparatus and a removing position where the toner cartridge is removed from the toner cartridge holder having:

a cartridge main body;

a toner chamber that is provided inside the cartridge main body and contains toner;

an opening that enables movement of the toner between a position inside the toner chamber and a position outside the cartridge main body; and a regulation part that regulates movement of toner cartridge with respect to the toner cartridge holder when the toner cartridge holder is rotated between the attaching position and the removing position, wherein the regulation part is configured to permit predetermined linear movements and predetermined rotational movements.

9. The image forming apparatus according to claim 8, wherein the image forming apparatus main body includes an open-close cover that is configured to be opened/closed and a connection part that connects the open-close cover with the toner cartridge holder so as to move the toner cartridge holder in accordance with the opening and closing of the open-close cover.

10. The image forming apparatus according to claim 8, wherein the regulation part regulates the movement of the toner cartridge with respect to the toner cartridge holder by a groove provided in the toner cartridge.

11. The image forming apparatus according to claim 9, wherein the regulation part regulates the movement of the toner cartridge with respect to the toner cartridge holder by a groove provided in the toner cartridge.

12. The image forming apparatus according to claim 8, wherein at least a part of the opening is positioned on a side surface of the cartridge main body.

13. The image forming apparatus according to claim 9, wherein at least a part of the opening is positioned on a side surface of the cartridge main body.

14. The image forming apparatus according to claim 10, wherein at least a part of the opening is positioned on a side surface of the cartridge main body.

15. The image forming apparatus according to claim 11, wherein at least a part of the opening is positioned on a side surface of the cartridge main body.

16. The image forming apparatus according to claim 8, wherein the opening has at least one of a toner supply port to supply the toner and a toner reception port to receive the toner.

17. The image forming apparatus according to claim 9, wherein the opening has at least one of a toner supply port to supply the toner and a toner reception port to receive the toner.

18. The image forming apparatus according to claim 10, wherein the opening has at least one of a toner supply port to supply the toner and a toner reception port to receive the toner.

19. The image forming apparatus according to claim 11, wherein the opening has at least one of a toner supply port to supply the toner and a toner reception port to receive the toner.

20. The image forming apparatus according to claim 12, wherein the opening has at least one of a toner supply port to supply the toner and a toner reception port to receive the toner.

21. The toner cartridge according to claim 1, further comprising an open-close member that opens/closes the opening by moving, wherein the regulation member also regulates the open-close member in an opening/closing direction when the cartridge main body is moved in a direction where it is removed/attached to an image forming apparatus.

22. The toner cartridge according to claim 21, wherein the regulation part comprises a grooved portion.

23. The toner cartridge according to claim 8, further comprising an open-close member that opens/closes the opening by moving, wherein the regulation member also regulates the open-close member in an opening/closing direction when the cartridge main body is moved in a direction where it is removed/attached to an image forming apparatus.

24. The toner cartridge according to claim 23, wherein the regulation part comprises a grooved portion.

* * * * *